US005615943A

United States Patent [19]

Coldren

[11] Patent Number: 5,615,943

[45] Date of Patent: Apr. 1, 1997

[54] LAMP AND REFLECTOR BRACKET FOR FLUORESCENT FIXTURES

[76] Inventor: C. Michael Coldren, P.O. Box 921, Edmond, Okla. 73083-0921

[21] Appl. No.: 603,115

[22] Filed: Feb. 20, 1996

[51] Int. Cl.[6] ..... F21S 3/00; F21V 21/14

[52] U.S. Cl. ..... 362/220; 362/225; 362/280; 362/319; 362/430; 362/285

[58] Field of Search ..... 362/217, 220, 362/225, 260, 277, 280, 319, 240, 237, 238, 239, 346, 418, 430, 285

[56] References Cited

U.S. PATENT DOCUMENTS

| | | | |
|---|---|---|---|
| 2,986,627 | 5/1957 | Marriett . | |
| 4,161,019 | 7/1979 | Mulvey | 362/220 |
| 4,422,132 | 12/1983 | Trowbridge | 362/220 |
| 4,599,684 | 7/1986 | Lee | 362/277 |
| 4,669,033 | 5/1987 | Lee | 362/277 |
| 4,961,127 | 5/1989 | Shemitz et al. | 362/285 |
| 5,371,661 | 12/1994 | Simpson | 362/220 |

*Primary Examiner*—Ira S. Lazarus
*Assistant Examiner*—Thomas M. Sember
*Attorney, Agent, or Firm*—Robert K. Rhea

[57] ABSTRACT

Pairs of laterally adjustable planar brackets supporting fluorescent lamp terminal posts are provided with individual lamp reflectors extending between and secured to opposing pairs of cooperating brackets for retrofitting existing fluorescent lamp fixtures with improved fluorescent lamps and reflectors.

4 Claims, 2 Drawing Sheets

LAMP AND REFLECTOR BRACKET FOR FLUORESCENT FIXTURES

BACKGROUND OF THE INVENTION

This invention relates to fluorescent lamp fixtures and more particularly to a lamp mounting bracket and individual lamp reflector for upgrading the efficiency of lamps by retrofitting lamp assemblies with lamp brackets and individual lamp reflectors.

1. Field of the Invention

Recent improvements in fluorescent lamps have increased candle power and reduced current consumption. Adding new reflectors can result in an increase in the efficiency of a lamp fixture. It has been found that the current ceiling mounted fluorescent lamp assemblies can be retrofitted with one pair of lamps instead of two pairs, with each lamp of the replacement pair having an individual reflector, which substantially increases illumination as well as effecting a saving in electric current.

This retrofitting necessitates changing the lamp mounting brackets and reflectors which is accomplished by removing the originally installed lamps and brackets, and replacing them with the brackets of this invention and a pair of improved lamps and individual lamp reflectors.

2. Description of the Prior Art

I do not know of any patents which disclose the lamp mounting brackets and reflectors of this invention. U.S. Pat. No. 2,986,627 issued May 30, 1961 to Marriett for ILLUMINATED VALANCE, and U.S. Pat. No. 4,961,127 issued Oct. 2, 1990 to Shemitz et al, for LAMP SOCKET MOUNTING BRACKET are considered examples of the state-of-the art.

The Mariett *627 patent discloses cooperating U-shaped and L-shaped brackets which support a lighting fixture housing and lamp terminal sockets on a vertical wall behind a valance for illuminating the latter.

The Shemitz *127 patent discloses a pair of cooperating clamp members gripping respective end portions of a fluorescent lamp and supporting it within a reflector.

This invention is distinctive over these patents and conventional mounting brackets for fluorescent lamps in ceiling recessed fixtures, by providing a pair of brackets supporting lamp terminal posts and moveable toward and away from each other which may be secured within a fluorescent lamp housing and support a pair of fluorescent lamps. The brackets further include a fastener for supporting respective end portions of a fluorescent lamp reflector.

SUMMARY OF THE INVENTION

A pair of generally planar sheet material brackets each having a longitudinal laterally extending arm portion disposed in longitudinal sliding superposed relation, form a bracket assembly in which the brackets may be moved toward and away from each other and secured within a ceiling mounted fluorescent lamp supporting housing at respective ends thereof.

The brackets each have a slotted tongue portion projecting toward the bracket assembly at the other end of the housing which supports a reflector holding pin. Each bracket is provided with a struck out platform opposite its reflector holding pin which supports a lamp terminal post for supporting respective ends of a fluorescent lamp. A pair of juxtaposed lamp reflectors are secured at respective end portions by the respective bracket reflector supporting pin.

DESCRIPTION OF THE PREFERRED EMBODIMENTS

Figure 2:
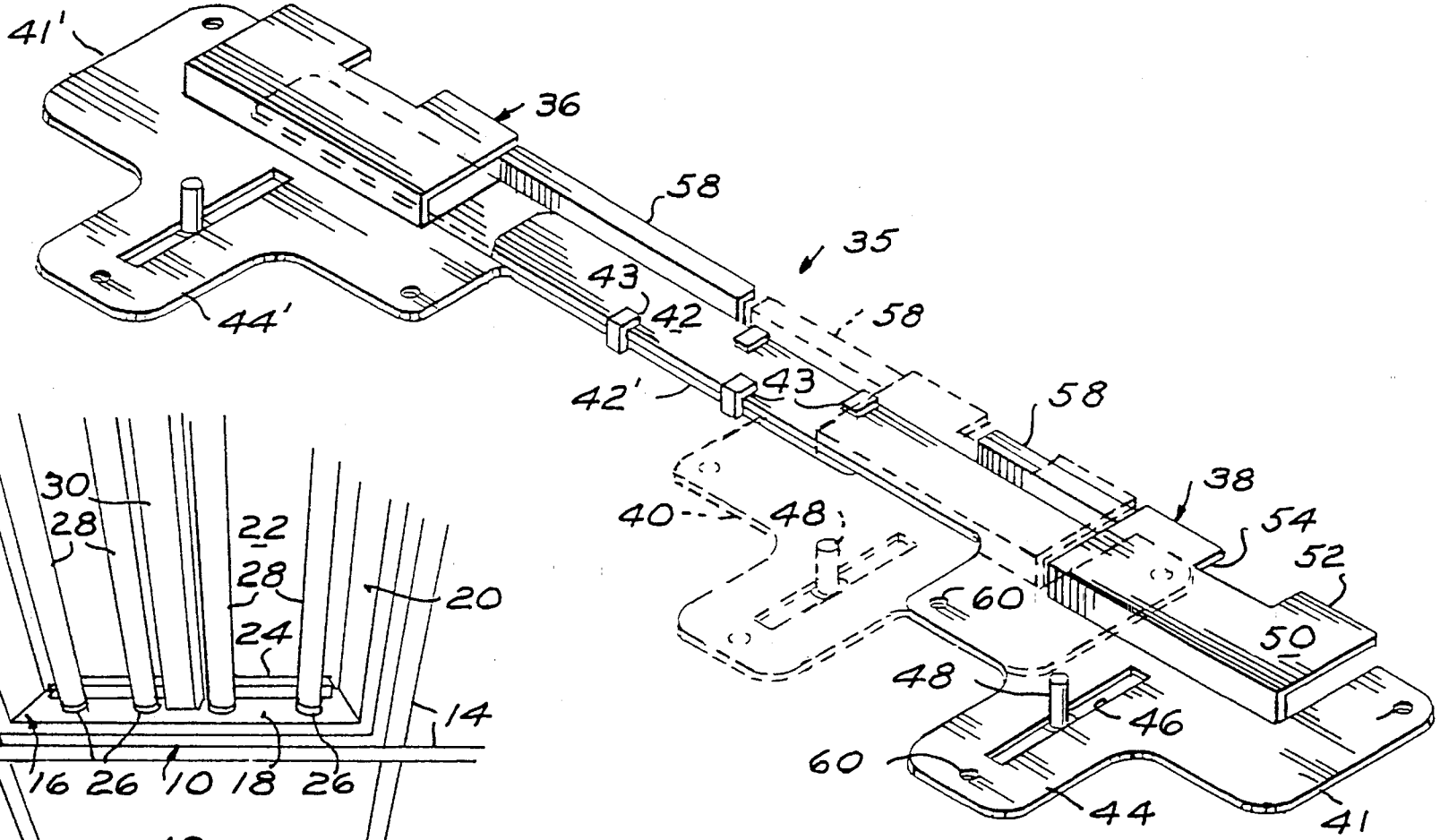
FIG. 2 is an isometric view of a lamp supporting bracket assembly and illustrating, by dotted lines, movement of one bracket toward the other; and, FIG. 3 is a fragmentary isometric view of one end portion of the bracket assembly and lamp reflectors in operative position, one reflector being illustrated by phantom lines.
Figure 1:
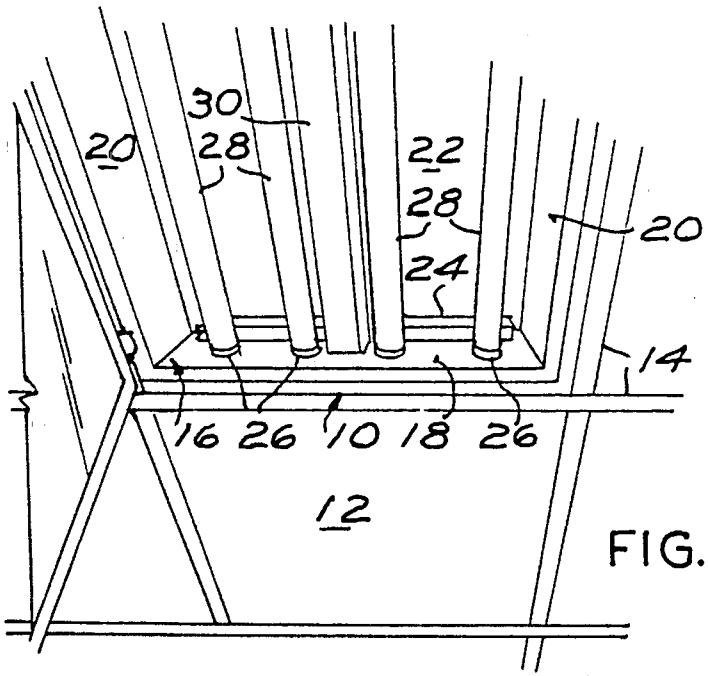
FIG. 1 is a fragmentary perspective view of one end portion of a conventional ceiling recessed lamp fixture and lamps.

Like characters of reference designate like parts in those figures of the drawings in which they occur.

In the drawings:

The reference numeral 10 illustrates one end portion of a fluorescent lamp assembly recessed in a ceiling and supported by hangers 14. The lamp assembly 10 comprises a downwardly open box-like light reflecting housing 16 having end wall 18, only one being shown, side walls 20 and a top 22 to joined to the side walls and end walls. A lamp support bracket 24 at each end of the housing is secured to the top wall 22 and supports two pairs of lamp terminal support posts 26 which, in turn, supports a like plurality of fluorescent lamps 28. A box-like shield 30 coextensive with the housing 16 is secured at its respective end portions to the respective bracket 24 and shields ballast and wiring connected to a source of electrical energy, neither being shown. The above description is conventional with many ceiling recessed fluorescent lamp assemblies, and is set forth to show the combination with which the invention is intended to be used.

The reference numeral 35 indicates a fluorescent supporting lamp bracket assembly to be secured in each end portion of the lamp fixture housing 16 as presently described. The bracket assembly 35 comprises a pair of brackets 36 and 38. Since the brackets 36 and 38 are mirror images of each other, only the bracket 38 will be described in detail, and reference numerals of identical parts of the bracket 36 having prime numerals, in the interest of brevity. The bracket 38 is formed from planar sheet material comprising a generally rectangular base portion 40 having a lateral side edge 41 to be disposed adjacent one of the housing walls 20 as hereinafter described. The opposite side of the base 40 is provided with an elongated laterally projecting arm cooperatively overlying the arm 42' of bracket member 36 in superposed relation.

The arms 42 and 42' are maintained in longitudinal sliding relation by a plurality of guides such as clips 43. The base member 40 is centrally provided with a tongue portion 44 projecting forwardly toward the opposite end of the housing 16 parallel with the tongue 44' of the bracket 36 in underlying relation with respect to a lamp reflector as presently described. The tongue is provided with an elongated slot 46, extending longitudinally of the housing 16, which slidably receives a fastener such as an upstanding pin 48 for securing a lamp reflector thereto as presently described. Opposite the tongue 44, a rectangular portion of the base is struck upwardly, as viewed in the drawings, to form a platform 50 parallel with the plane of the base 40 for the reasons which will now be explained.

Figure 3:
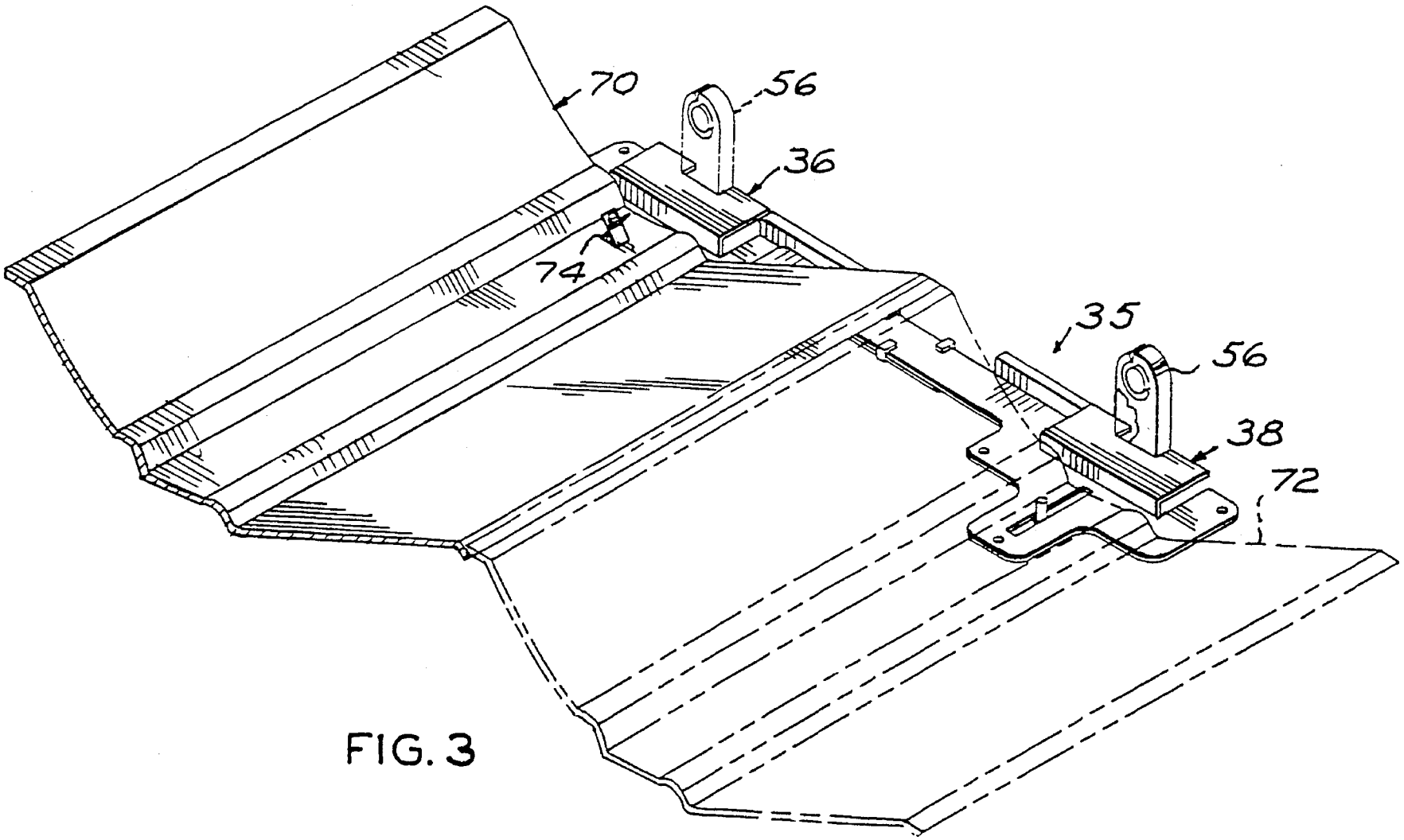

The rearward edge portion 52 of the platform is provided with a rectangular recess, as at 54, for nesting a peripheral portion of an upstanding fluorescent tube terminal support post 56 (FIG. 3). The rearward edge portion of each arm 42 and 42' are similarly struck upwardly to form a rearwardly open inverted L-shape shield 58, for shielding electrical wiring, not shown. The base member 40 and its tongue 44 is provided with a plurality of apertures 60 for receiving pop rivets, not shown, to secure the lamp bracket assembly 35 to the fluorescent fixture housing wall 22 adjacent the respective end wall 18 thereof.

OPERATION

In carrying out the invention, the two pairs of fluorescent lamps 28 are removed from the ceiling fixture housing and the brackets 24 and shield 30 are removed. One of the bracket assemblies 35 is laterally adjusted relative to the housing and secured to its wall 22 with the base side edges 41 and 41' faacing the housing respective side wall 20.

With the lamp terminal end support posts 56 in place, a pair of elongated transversely concave light reflectors 70 and 72 having a combined width substantially equal with the transverse width of the housing 16 are interposed between the confronting forward edges of the platforms 50. Each end portion of the reflectors is provided with an aperture which cooperatively surrounds the fastener mounting pin 48 and are held in place by a pin friction clip 74, only one being shown (FIG. 3). Thereafter, a pair of the above described improved fluorescent lamps, not shown are received by and supported by the terminal posts 56 to complete the retrofitting installation.

Obviously the invention is susceptible to changes or alterations without defeating its practicability. Therefore, I do not wish to be confined to the preferred embodiment shown in the drawings and described herein.

I claim:

1. In a fluorescent light fixture including an elongated downwardly open housing having side and end walls depending from a top wall and dimensioned to house fluorescent lamps and mounting brackets, the improvement comprising:

a pair of laterally adjustable planar brackets, each bracket mounted to said top wall adjacent said side walls and one of said end walls, respectively, each bracket of said pairs of brackets having a lamp terminal socket receiving recess adjacent the respective end wall;

a lamp terminal socket in the respective recess, said sockets being wired to a source of electrical energy;

each bracket of said pairs of brackets having light reflector mounting means disposed in confronting relation with respect to the respective bracket at an opposite end of the housing; and, a pair of light reflectors extending longitudinally of the housing between cooperating brackets of said pairs of brackets and supported by said reflector mounting means.

2. The combination according to claim 1 in which said reflector mounting means comprises:

a tongue on each bracket of said pairs of brackets projecting longitudinally of said housing in confronting relation with respect to the tongue on a cooperating bracket at the opposite end of the housing, each said tongue having an elongated slot; and, a light reflector gripping fastener longitudinally slidable in the tongue slot.

3. Fluorescent lamp mounting apparatus for retrofitting a fluorescent light fixture having a housing, comprising:

at least a first pair of planar brackets, each said bracket of said pair of brackets having a base for mounting said brackets to said housing in aligned spaced opposition;

a tongue extending from said base in longitudinally aligned relation with respect to an opposite bracket, said tongue having a longitudinally extending slot;

a fluorescent lamp terminal post supporting platform on said base opposite said tongue;

a light reflector extending between said pair of brackets in overlying relation with respect to said tongues; and, fastener means slidable in said tongue slots for securing said reflector to said pair of brackets.

4. The apparatus according to claim 3 and further including;

a second pair of brackets in juxtaposition with said first pair of brackets;

each bracket of said first and second pairs of brackets having a laterally projecting arm superposed with respect to an arm of the adjacent bracket; and, guide means on at least one said arm for maintaining said arms in longitudinal alignment during lateral movement of one bracket with respect to the other bracket of the respective pair of brackets of said pairs of brackets.

* * * * *